US008148618B1

(12) United States Patent
Vaden

(10) Patent No.: US 8,148,618 B1
(45) Date of Patent: Apr. 3, 2012

(54) PNEUMATIC DRUM TUNING DEVICE, SYSTEM AND METHOD

(76) Inventor: Sarah Vaden, Atlanta, GA (US)

( * ) Notice: Subject to any disclaimer, the term of this patent is extended or adjusted under 35 U.S.C. 154(b) by 22 days.

(21) Appl. No.: 12/894,673

(22) Filed: Sep. 30, 2010

(51) Int. Cl.
*G10D 13/02* (2006.01)

(52) U.S. Cl. ..... 84/411 R

(58) Field of Classification Search ..... 84/411 R, 84/421

See application file for complete search history.

(56) References Cited

U.S. PATENT DOCUMENTS 3,240,096 A 3/1966 Sloan
5,392,681 A 2/1995 Hall
5,427,009 A 6/1995 LaPlante
6,069,307 A 5/2000 Rogers
6,198,033 B1 * 3/2001 Lovelett ..... 84/411 R

* cited by examiner

*Primary Examiner* — Kimberly Lockett
(74) *Attorney, Agent, or Firm* — Sutherland Asbill & Brennan LLP

(57) ABSTRACT

A drum tune adjustment system is provided for adjusting the pitch of a drum having a shell, a batter head, a resonant head, and a cavity formed therewithin. The drum tune adjustment system includes an air pump or air source, and a conduit fluidly connected with the air pump or air source. The system further includes a connector that is configured to attach the conduit to the shell of the drum such that the cavity of the drum is fluidly connected with the air pump or air source via the conduit. The system further includes a pedal that is configured to actuate the air pump or open a valve that is fluidly connected with the air source and thereby move a mass of air between the air pump or air source and the cavity of the drum when the conduit is attached to the drum with the connector.

25 Claims, 8 Drawing Sheets

PNEUMATIC DRUM TUNING DEVICE, SYSTEM AND METHOD

CROSS-REFERENCES TO RELATED APPLICATIONS

Not applicable.

FIELD OF THE INVENTION

The present invention relates generally to the field of musical instruments, and more particularly to a pneumatic drum tuning system.

BACKGROUND

FIG. 1 illustrates a drum 10, such as a tom, that may be employed on a drum kit. The drum 10 includes a shell 14 and a hoop 20 for securing a drum head 12 to one end of the shell 14. In most cases, a second hoop 26 is employed on the other end of the shell 14 to attach a second drum head (not shown) to the drum 10. The shell 14 may comprise various materials including, but not limited to, wood, metal, or plastic such as an acrylic resin plastic. Most drum shells are made from wood, e.g., maple, birch, lauan, or poplar, and comprise layers of wood material that are joined together by adhesive layers. The shell 14 has a bearing edge at each end that contacts the drum head 12. The shell 14 may include one or more vent holes 28. The drum head 12 may be formed of a material that is stretchable, such as a plastic, e.g., mylar or kevlar.

The drum head 12 and the hoop 20 are attached to the shell 14 via tension rods 22 that pass through the hoop 20 and engage the lugs 24 that are attached to the exterior of the shell 14. The tension rods 22 are arranged in a circular pattern around the drum head 12. Most drums have between 6 to 10 tension rods per head. The tension rods 22 comprise a screw portion with male threading that engages female threading in the lug 24. As the tension rods 22 are screwed into the lugs 24, the drum head 12 is pulled taught across the bearing edge of the shell 14 by the hoop 20. The hoop 20 also includes a rim 16 which extends away from the plane of the drum head 12.

The drum is tuned by adjusting the tension rods 22 to adjust the degree of which the drum head 12 is stretched across the bearing edge of the shell 14. As the tension rods 22 are tightened into the lugs 24, the pitch of the fundamental note of the drum 10 increases. The tension rods 22 typically have a low profile square head 18 that is engaged by a drum key to tighten or loosen the tension that a hoop 20 places on the drum head 12 adjacent to the tension rod 22.

Drum tuning can be a lengthy process in which a user iteratively adjusts the tension rods 22 to establish an even tension across the head 12 and the desired head tension to yield the desired pitch. Most drums have two heads—a batter head and a resonant head. The process must therefore be repeated for both drum heads and then further adjustment may be required to match the tension of the resonant head to the tension of the batter head to achieve the desired tone, attack, ring, and overtone for the drum. Further adjustment may be required to adjust the pitch variation between drums on the kit. This tuning method takes a long time and therefore occurs prior to a performance.

Other drums exist that can be tuned on-demand during performance. For example, the pitch of a rototom may be adjusted on-on demand by rotating the drum head assembly of the drum. This rotation causes the hoop and head to move relative to a bearing edge as the drum head assembly travels along a screw. These drums do not employ a shell or resonant head and may be useful only in a narrow range of drumming applications.

Accordingly, it would be desirable to provide new drums that may tuned on demand, such as during a performance. It would also be desirable to provide tuning systems that may be employed on a user's existing drums.

SUMMARY

In one aspect, a drum tune adjustment system is provided for adjusting the pitch of a drum having a shell, a batter head, a resonant head, and a cavity formed therewithin. The drum tune adjustment system includes an air pump or air source, and a conduit fluidly connected with the air pump or air source. The system further includes a connector that is configured to attach the conduit to the shell of the drum such that the cavity of the drum is fluidly connected with the air pump or air source via the conduit. The system further includes a pedal that is configured to actuate the air pump or open a valve that is fluidly connected with the air source and thereby move a mass of air between the air pump or air source and the cavity of the drum when the conduit is attached to the drum with the connector.

In another aspect, a method is provided for adjusting the tune of a drum. The method includes providing a first drum having a cavity defined by a shell, a batter head and a resonant head; and moving a mass of air into or out of the cavity, thereby altering the pitch of the first drum.

DESCRIPTION

Systems and methods are provided for tuning one or more drums, e.g., changing their pitch, during a performance. For example, in some embodiments, the systems and methods of the present invention may be employed to quickly change the pitch of a drum while playing a song or between songs during a set.

Drum Tuning System

In one aspect, a drum tune adjustment system is provided for adjusting the pitch of a drum having a cavity bounded by a shell, a batter head and a resonant head. The drum tune adjustment device may include an air pump, a conduit fluidly connecting the air pump to the cavity of the drum. A connector may be provided to attach the conduit to the shell of the drum. The drum tune adjustment system may further include a pedal that is configured to actuate the air pump thereby moving a mass of air between the air pump and the cavity of the drum through the conduit.

Figure 1:
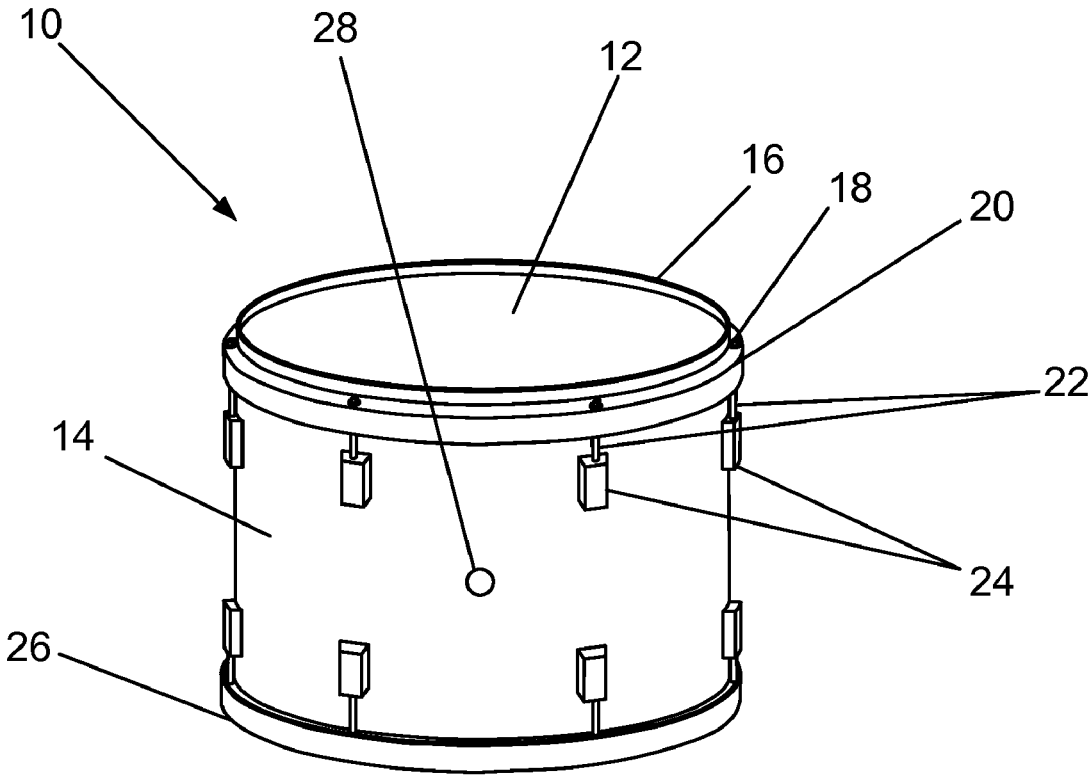
FIG. 1 (Prior Art)
FIG. 1 is a perspective view, illustrating a drum.
Figure 2:
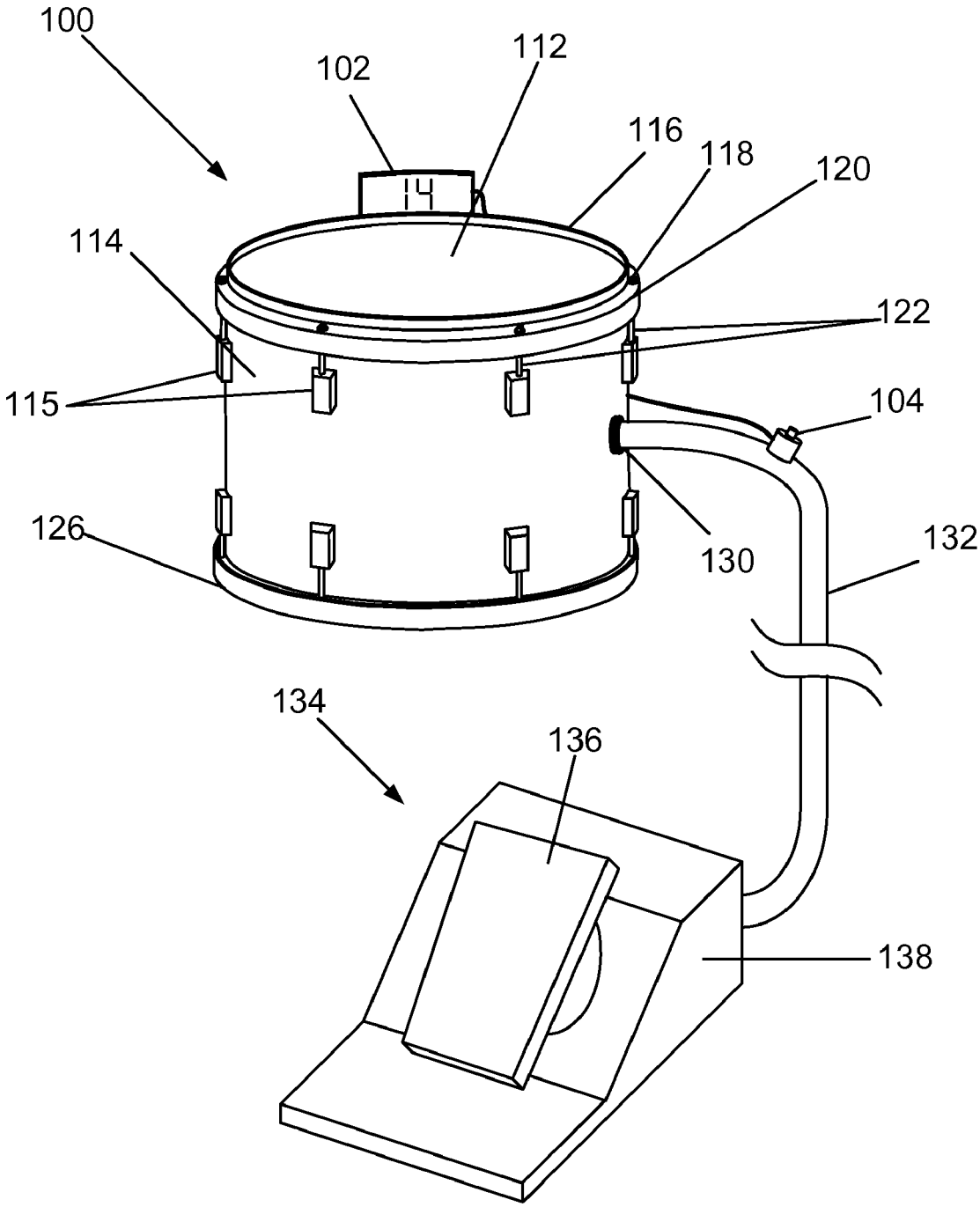
FIG. 2 is a perspective view, illustrating a drum tuning system in accordance with one or more embodiments of the present invention.

Embodiments of the present invention are illustrated in claims 2-4. FIG. 2 illustrates a drum 100, such as a tom, that may be employed on a drum kit. Although a tom is illustrated, it should be noted that the present invention may be used with any drum having a shell, a batter head, and a resonant head. For example, the present invention may also be employed with a snare drum or a bass drum. The present invention may also be employed with a drum having only a batter head with an enclosed shell, e.g., a kettle drum.

The drum 100 includes a shell 114 and a hoop 120 for securing a drum head 112 to one end of the shell 114. A second hoop 126 is employed on the other end of the shell 114 to attach a second drum head (not shown) to the drum 100. The shell 114 may comprise various materials including, but not limited to, wood, metal, or plastic such as an acrylic resin plastic. The shell 114 has a bearing edge (not shown) at each end that contacts each drum head. The drum head 112 may be formed of a material that is stretchable, such as a plastic, e.g., mylar or kevlar.

The drum head 112 and the hoop 120 may be attached to the shell 114 via tension rods 122 that pass through the hoop 120 and engage the lugs 115 that are attached to the exterior of the shell 114. The tension rods 122 may be arranged in a circular pattern around the drum head 112. In some embodiments, the drum 100 has between 6 to 10 tension rods per head. The tension rods 122 comprise a screw portion with male threading that engages female threading in the lug 115. As the tension rods 122 are screwed into the lugs 115, the drum head 112 is pulled taught across the bearing edge of the shell 114 by the hoop 120. The hoop 120 may also include a rim 116 which extends away from the plane of the drum head 112.

A pedal assembly 134 is provided for actuating drum tune adjustment. The pedal assembly 134 includes a pedal 136 and a housing 138 which contains an air pump. The pedal 136 may be moved from an extended to a depressed position by applying pressure to the pedal 136, e.g., by standing on the pedal 136 or by apply pressure to the pedal 136 with a foot. The air pump may be any pump suitable for moving air. For example, the air pump may be a positive displacement pump. The pump may comprise, for instance, a bellows or a piston that travels through a cylinder. Alternatively, the pump may comprise an inflatable bladder.

A conduit 132 is provided for moving air between the cavity of the drum 100 and the air pump of the pedal assembly 134. The conduit 132 may be attached to the drum 100 via a connector 130 which allows the conduit 132 to fluidly connect the cavity of the drum to the air pump. The connector 130 may be, for instance, a bung that is insertable into the vent hole of the drum 100. The conduit 132 may pass through the bung so that the inside of the conduit 132 is in fluid communication with the cavity of the drum 100. Other types of connectors may also be used.

The air pump may be configured to move a mass of air into or out of the cavity of the drum 100 via the conduit 132 to change the pitch of the drum. As described above, the drum 100 may tuned to an initial desired pitch by adjusting the tension rods 122 to set provide the initial desired tension to the drum head 112. When the drum 100 is pressurized or depressurized, tension is added to the drum head 112 as the change in pressure stretches the drum head 112 beyond its standard tuning, i.e., the change in pressure adds tension beyond that which would normally be exerted on the drum head 112 by the hoop 120 and tension rods 122. In the instance that air is added to the cavity, the added air mass exerts pressure evenly on the drum head 112 and pushes the drum head 112 away from the center of the cavity, thereby adding tension to the drum head 112. In the instance that air is removed from the cavity, the reduced air mass creates a pressure differential between the cavity and the air outside of the drum head 112 causing the air outside of the drum head 112 to exert pressure evenly on the drum head 112 and push the drum head 112 toward the center of the cavity, thereby adding tension to the drum head 112. It should be noted that the change in pressure adds tension to both the batter head and the resonant head.

In some embodiments, the pressurization or depressurization of the cavity relative to atmosphere may also result in the enhancement of the second fundamental note of the drum. In one experiment, the harmonic modes produced when a mallet was dropped from a fixed distance on a drum head was analyzed. An input transducer (microphone) was placed near the drum head and Fast Fourier Transform software was used to evaluate the acoustic response of the drum head. A shift of the frequency of the fundamental note was observed as air mass was added to the cavity of the drum. Surprisingly, an amplification of the secondary fundamental note was also observed as air mass was added to the cavity of the drum.

Figure 3:
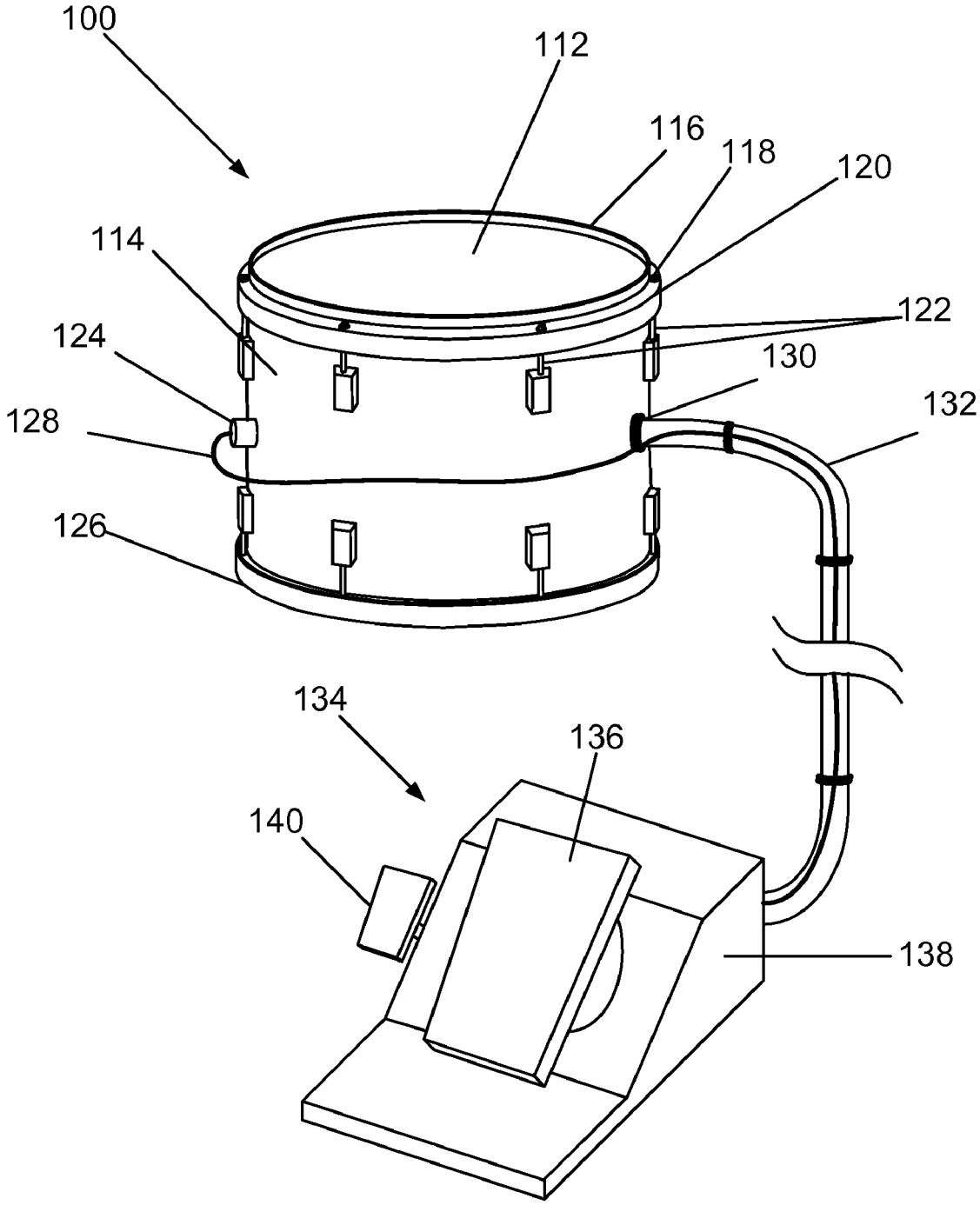
FIG. 3 is a perspective view, illustrating a drum tuning system in accordance with one or more embodiments of the present invention.

A relief valve 104 may be provided for venting air into or out of the drum cavity. The relief valve 104 may be provided on the conduit 132 as shown or may be placed at another location, such as on the pedal assembly 134, on the shell 114, or on the connector 130. In one embodiment, the relief valve 104 may automatically vent air to the atmosphere or into the drum once a desired pressure differential is exceeded. In certain embodiments, the pressure differential at which the relief valve is automatically actuated may be adjusted by the user. In some embodiments, the relief valve 104 may be actuated on demand by a user, such as by pressing a button. In some embodiments, as illustrated in FIG. 3, a relief valve 124 may be actuated remotely by depressing a relief pedal 140 provided on the pedal assembly 140. A cable 128, similar to a cable used on bicycle hand brake, may link the relief pedal 140 to the relief valve 124. As such, the user may open the relief valve 124 to vent air into or out of the drum by stepping on the relief pedal 140 or applying pressure to the relief pedal 140. The relief valve 124 is shown integrated directly to the shell 114 in FIG. 3 to illustrate an alternate mounting location for the relief valve. In the illustrated embodiment, the relief valve 124 may be mounted directly to the shell 114 via a second vent hole, assuming drum 100 is so equipped. Alternatively, a second vent hole may be cut into the shell 114 to receive the relief valve 124.

Referring back to FIG. 2, a display device 102, which may be a digital display device, may be provided for indicating the relative pressure of the cavity of the drum 100. A pressure transducer or other device may be employed to measure the pressure differential. In some embodiments, the pressure transducer may be integrated with the relief valve 104. The display device 102 may be configured to be mountable to the drum 100. For example, the display device 102 may attach to the hoop 120, the tension rods 122, the lugs 115 or to other drum kit hardware. A control module may be provided in the display device 102 for programmably controlling the actuation of the relief valve 104.

Figure 4:
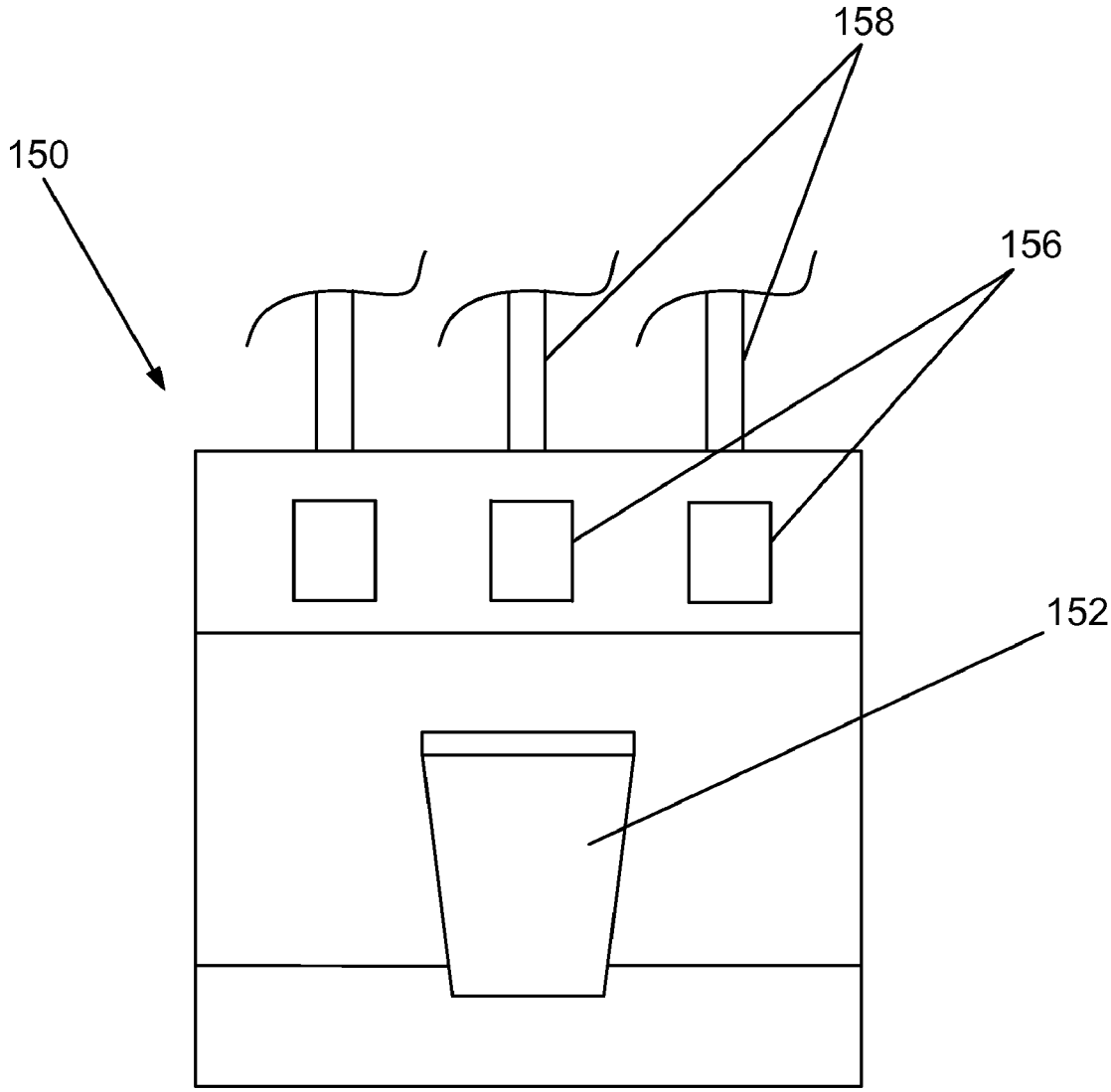
FIG. 4 is a top view, illustrating a pedal for use with a drum tuning system in accordance with one or more embodiments of the present invention.

In some embodiments, a single pedal may be used to control the internal pressure of more than one drum. For example, as illustrated in FIG. 4, a pedal assembly 150 may include a single pedal 152 and multiple drum selector actuators 156 for selecting which of a plurality of conduits 158 are subjected to pump pressure. In one embodiment, the pedal 152 and/or air pump may be moved into alignment with the desired conduit 158 to pressurize or depressurize the desired drum. For example, the pedal 152 may be slid horizontally or may pivot to cause the air pump to direct air flow through the desired conduit 158. The user may then step on the pedal 152 to actuate the pump mechanism. In some embodiments, the conduits 158 may all be fluidly connected with a common manifold that is fluidly connected with the air pump. The drum selector actuators 156 may be used to actuate a valve, e.g., a gate or sluice valve, to open or close the conduit to the air pump. In such an embodiment, the user may step on the drum selector actuator(s) 156 corresponding to the desired drum(s), to open the valves in the conduits 158 and then may press on the pedal 152 to actuate the air pump and provide air flow through the selected conduits through the valves.

In some embodiments, drum tune adjustment systems may include other features to enhance the performance of the system or drum. For example, in some embodiments, the system is enhanced by sealing the fasteners that join the lugs 115 to the shell 114. For example, a sealant may be applied around the fasteners. Alternatively, compressible o-rings or other structures may be employed around the fasteners. Also, in some embodiments, the system is enhanced by employing a gasket, o-ring, or other sealing structure around the bearing edge of the shell 114 to minimize the leakage of air between the bearing edge and the drum head 112.

Figure 5:
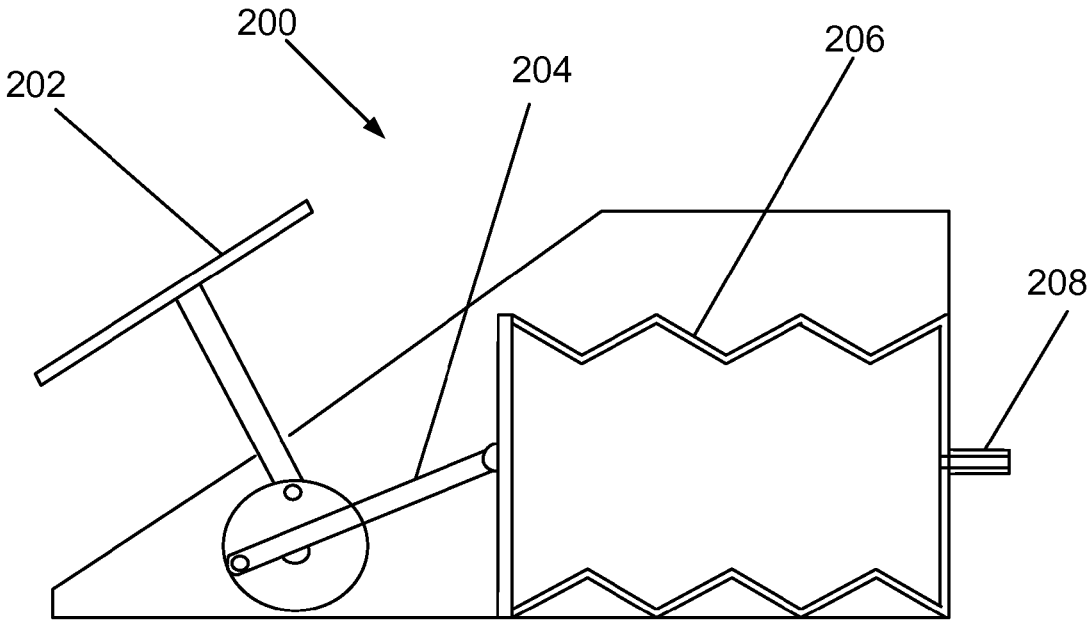
FIG. 5 is a section view, illustrating a pedal for use with a drum tuning system in accordance with one or more embodiments of the present invention.

Various mechanisms may be employed to allow for the use of a pedal to actuate the movement of air mass into or out of the drum cavity. For example, as illustrated in FIG. 5, a pedal assembly 200 is provided that includes a bellows pump 206 that may be actuated by a pedal 202 to supply air through a conduit that is connected to an outlet 208. The movement of the pedal 202 may be translated into the movement of actuator arm 204 such that the bellows 206 compresses and expels air from the outlet 208 when the pedal 202 is moved to a depressed position. The pedal 202 and/or the bellows pump 206 may biased, such as with a spring, so that the bellows pump 206 remains in the expanded state when no pressure is applied to the pedal 202 and the pedal 202 may return to its original position after the bellows pump 206 is compressed. During use, the pedal 202 may be pressed one or more times to pressurize the drum cavity. A one-way valve may be employed to prevent the backflow of air into the bellows pump 206 when the bellows pump 206 is returned to it normal expanded state. In certain embodiments, the flow-directionality of the one-way valve may be reversed and the bellows pump 206 may be spring biased in a compressed state so that pressing the pedal 202 evacuates air from the cavity of the drum.

Figure 6:
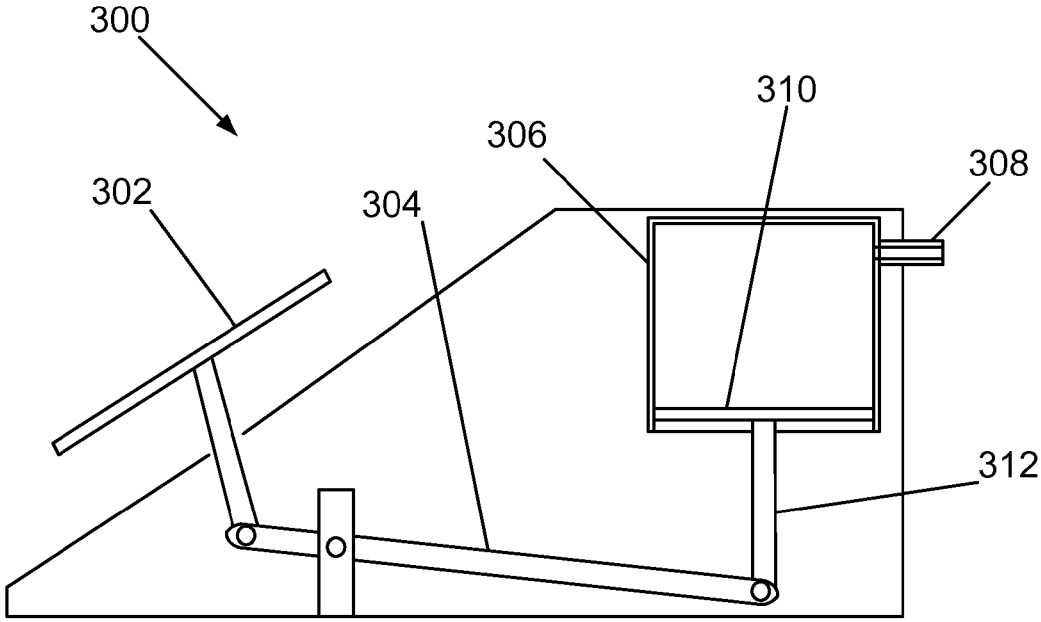
FIG. 6 is a section view, illustrating a pedal for use with a drum tuning system in accordance with one or more embodiments of the present invention.
Figure 7:
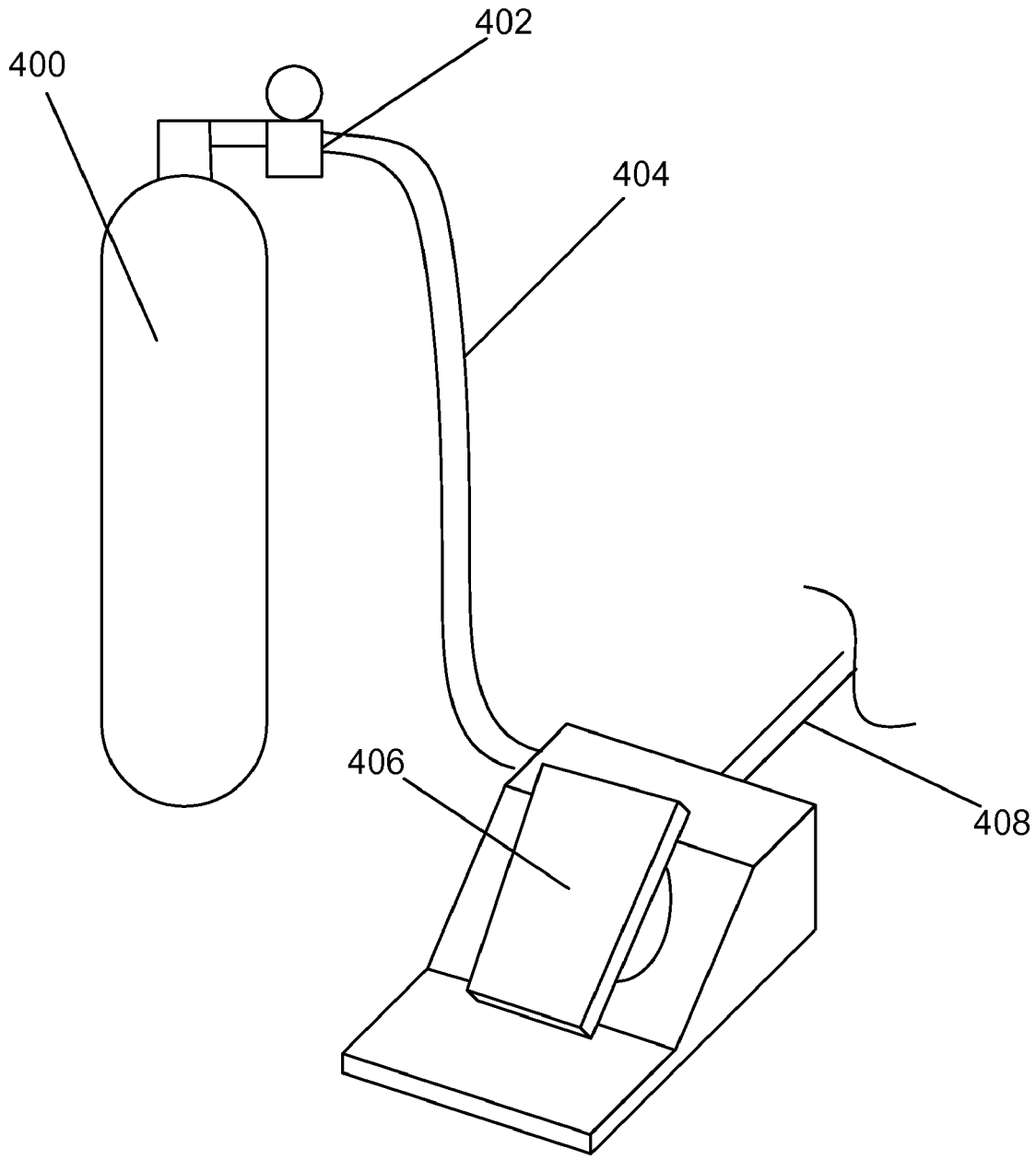
FIG. 7 is a perspective view, illustrating a drum tuning system in accordance with one or more embodiments of the present invention.

In another embodiment, as illustrated in FIG. 6, a pedal assembly 300 is provided that includes a pump cylinder 306 and a piston 310 that pump air through a conduit that is connected to an outlet 308. The movement of a pedal 302 may be translated into movement of a piston arm 312, such as through the movement of a lever arm 304, to advance or retract the piston through the cylinder 306. The piston 310 and/or the pedal 302 may be biased, such as with a spring, so that the piston 310 remains in a non-compression position (such as shown in FIG. 6) when no pressure is applied to the pedal 302 and the pedal 302 may return to its original position after the piston 310 moves to a compression position (such as near the top of the cylinder 306 in FIG. 6). During use, the pedal 302 may be pressed one or more times to pressurize the drum cavity. A one-way valve may be employed to prevent the backflow of air into the cylinder 306 when the piston 310 returns to it normal non-compressed position. In certain embodiments, the flow-directionality of the one-way valve may be reversed and the piston 310 may be spring-biased to remain in a compressed position so that pressing the pedal 302 evacuates air from the cavity of the drum.

In some embodiments, the pump is external to and/or remote from the pedal assembly housing. For example, the pump may be mechanically, pneumatically, or hydraulically linked to the pedal. Such a feature may allow the pedal assembly to assume a smaller footprint, which may be particularly beneficial in instances where space is limited for pedal placement. Moreover, in some embodiments, a mechanical pump may be replaced with a gas source having a static pressure head. For example, a pressurized air container 400 may be used as a source for air mass or pressure for adding air to the drum cavity. A regulator 402 may be employed to control the static head pressure of the pressurized air container 400. The pressurized air container 400 may supply air to the drum cavity via a conduit 404 that is fluidly connected with a valve that is actuated by the pedal 406. The valve that is actuated by the pedal 406 may be further fluidly connected to a conduit 408 that supplies air to the cavity of the drum. As such, the user may open the valve by pressing down on the pedal 406, thereby allowing air to flow from the pressurized air container 400 into the drum cavity. The pedal 406 may be released to close the valve.

It should be noted that the foregoing drum tune adjustment system may be provided as an accessory that a drummer may employ on their original drum equipment. Such a system advantageously may require only minimal or no alteration of the drummer's original drum equipment. In some embodiments, the drum tune adjustment system may be provided with drums that are specifically configured for use with the drum tune adjustment system.

Drum Tuning Methods

In another aspect, a method is provided for adjusting the tune of a drum. The method may comprise providing a first drum having a cavity formed between a shell, a batter head and a resonant head; providing a drum tune adjustment system attached to the first drum, the drum tune adjustment system comprising an air pump, a conduit fluidly connected with the air pump and the cavity of the first drum, and a pedal configured to actuate the air pump; and pressing the pedal to actuate the air pump and move a mass of air between the air pump and the cavity of the drum, thereby altering the pitch of the first drum.

In addition, methods are provided for tuning one or more drums on-demand, such as during a performance. Such methods may include pumping a mass of air into or out of one or more drums. The addition or removal air mass results in a pressure differential between the cavity of the drum and the atmosphere. This pressure differential may add more tension to the drum head, thereby increasing the pitch of the drum, e.g., the drum's fundamental note, relative to the normal pitch of the drum without the pressure differential.

In some embodiments, the tuning of one or more drums may be adjusted by providing a drum tune adjustment system attached to a drum, and pressing a pedal to actuate an air pump to move a mass of air between the air pump and the cavity of the drum through a conduit that fluidly connects the air pump to the cavity of the drum. In some embodiments, the pitch of multiple drums may be adjusted by the drum tune adjustment system, by selectively controlling which of the one or more drums are fluidly connected to the pump when the pump is actuated.

Figure 8:
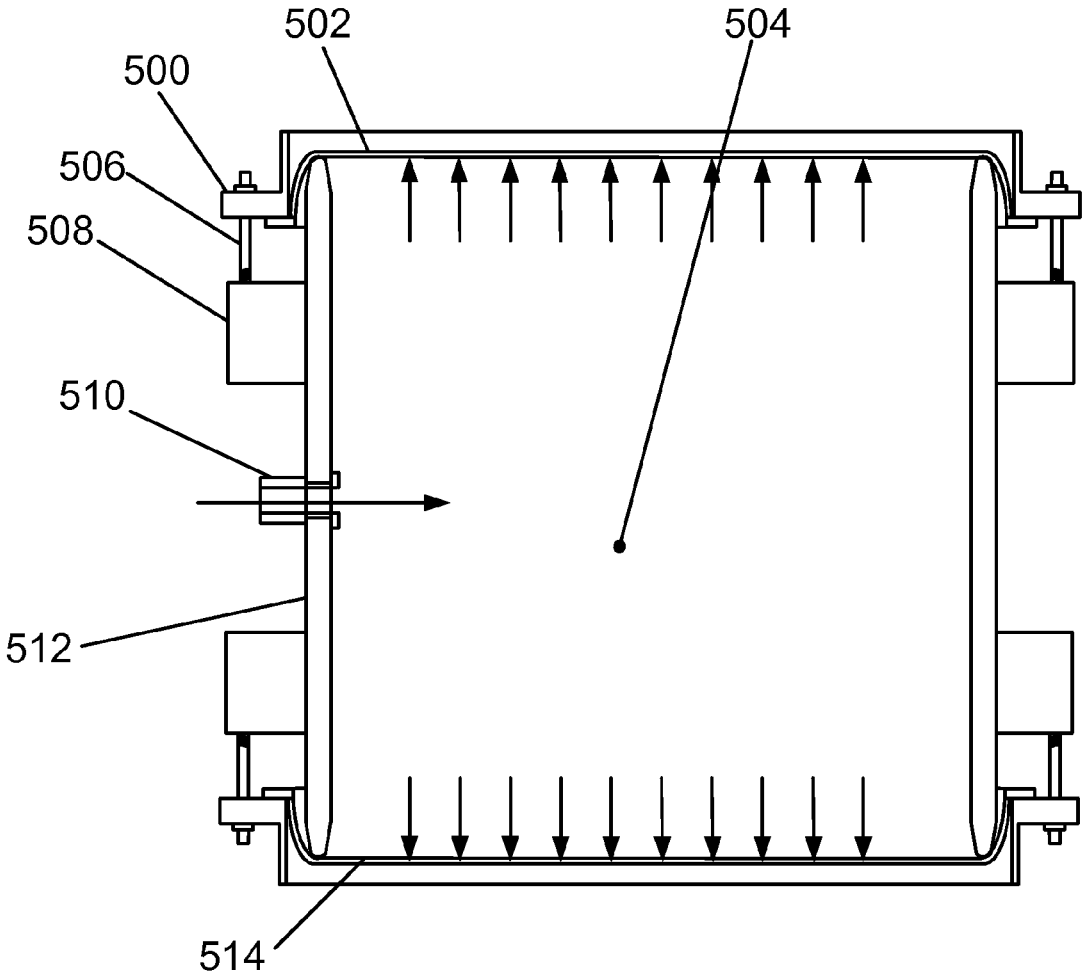
FIG. 8 is a section view, illustrating the tuning of a drum utilizing a drum tuning system in accordance with one or more embodiments of the present invention.

As illustrated in FIG. 8, in some embodiments, the drum tuning system may be employed to move a mass of air into a drum, e.g., to increase drum head tension. For example, a mass of air may be moved into the cavity 504 of a drum. The cavity may be defined by a top drum head 502, a bottom drum head 514 and a drum shell 512. The air may be moved into the cavity 504 via a connector 510 that is installed on the drum shell 512.

The initial pitch of the drum may be initially set by providing an initial tension to the drum heads 502 and 514. The initial tension of the drum heads 502 and 514 may be adjusted by tightening or loosening the tension rods 506 that pass through the hoop 500 and threadedly engage the lugs 508. The drum heads 502 may be set so that the drum has an initial desired pitch. In some embodiments, the drum may be initially tuned to a desired pitch such that the drum will play a desirable note when there is no pressure differential between the cavity 504 and the exterior of the drum, e.g., the drum cavity 504 vents to the atmosphere, and the drum is struck. In other embodiments, the drum may be initially tuned to a desired pitch by a providing an initial tension to the drum heads 502 and 514 by a combination of tightening the tension rods 506 and providing an initial pressure differential between the drum cavity 504 and the exterior of the drum.

After establishing an initial pitch, the drum may be tuned by moving a mass of air into the cavity 504 as shown in FIG. 8. The addition of air to the cavity 504 results in a pressure differential between the cavity 504 and the exterior of the drum. This pressure differential pushes the drum heads 502 and 514 away from away from the center of the cavity 504, thereby adding tension to the drum heads 502 and 514 and raising the pitch of the drum.

Figure 9:
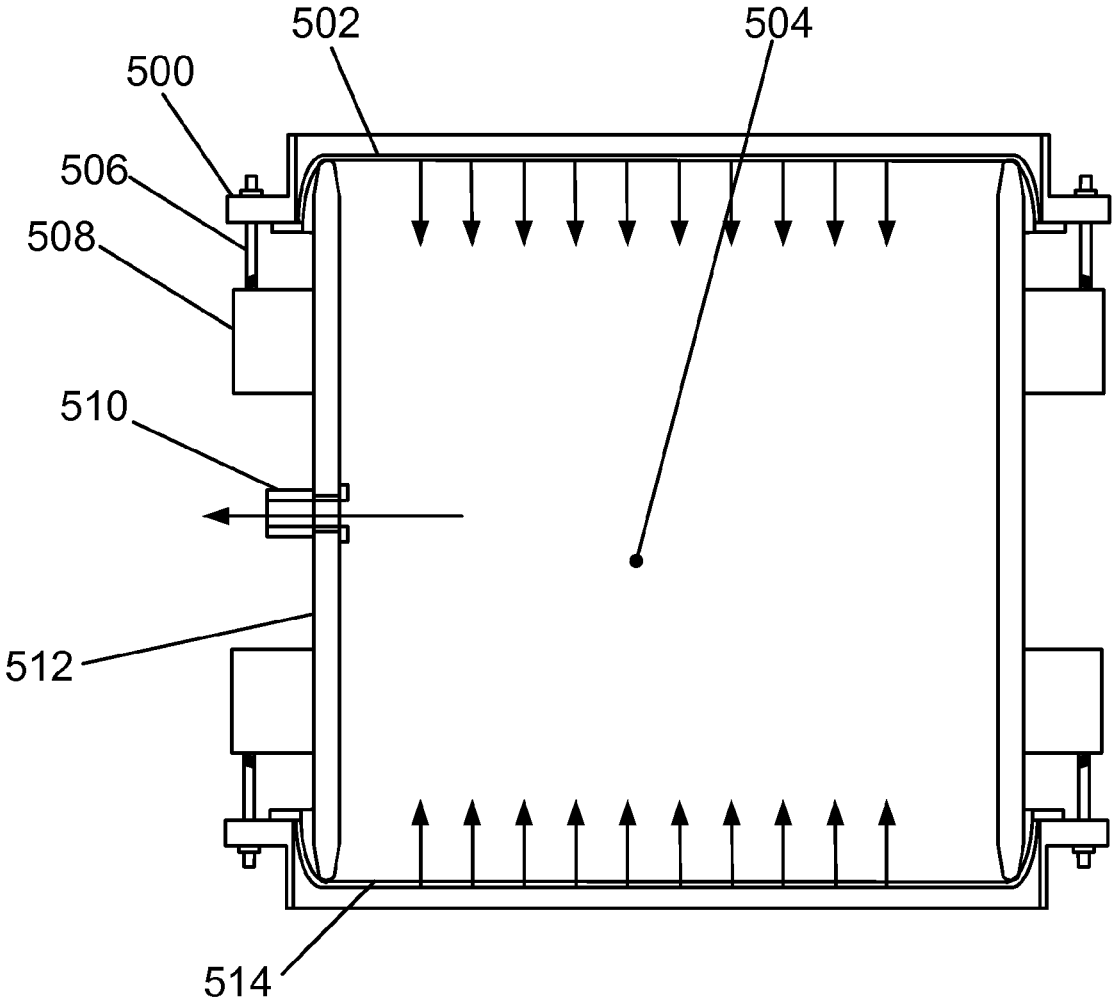
FIG. 9 is a section view, illustrating the tuning of a drum utilizing a drum tuning system in accordance with one or more embodiments of the present invention.

Alternatively, as illustrated in FIG. 9, after establish an initial pitch, the drum may be tuned may moving a mass of air out of the cavity 504. The evacuation of air from the cavity 504 results in a pressure differential between the cavity 504 and the exterior of the drum. This pressure differential pulls the drum heads 502 and 514 in towards the center of the cavity 504, thereby adding tension to the drum heads 502 and 514 and raising the pitch of the drum.

It should be apparent that the foregoing relates only to the preferred embodiments of the present invention that numerous changes and modifications may be made herein without departing from the spirit and the scope of the invention as defined by the following claims and equivalents thereof.

I claim:

1. A drum tune adjustment system for adjusting the pitch of a drum having a shell, a batter head, a resonant head, and a cavity formed therewithin, the drum tune adjustment system comprising:

an air pump or air source;

a conduit fluidly connected with the air pump or air source;

a connector configured to attach the conduit to the shell of the drum such that the cavity of the drum is fluidly connected with the air pump or air source via the conduit; and a pedal configured to actuate the air pump or open a valve that is fluidly connected with the air source and thereby move a mass of air between the air pump or air source and the cavity of the drum when the conduit is attached to the drum with the connector.

2. The drum tune adjustment system of claim 1, wherein the air pump comprises a bellows.

3. The drum tune adjustment system of claim 1, wherein the air pump comprises a piston and a cylinder.

4. The drum tune adjustment system of claim 1, wherein the air source comprises a pressurized air container.

5. The drum tune adjustment system of claim 1, further comprising a relief valve adapted to vent air into or out of the cavity of the drum when actuated.

6. The drum tune adjustment system of claim 1, further comprising a display for indicating the relative air pressure of the cavity.

7. The drum tune adjustment system of claim 1, further comprising a pedal assembly, the pedal assembly being attached to or mechanically, pneumatically, or hydraulically linked to the air pump and mechanically linked to the pedal such that the pedal can move between an extended position and a depressed position.

8. The drum tune adjustment system of claim 7, wherein the pedal assembly is configured to selectively adjust the pitch of a plurality of drums.

9. The drum tune adjustment system of claim 1, wherein the drum tune adjustment system is configured to move the mass of air into the cavity of the drum when the conduit is attached to the drum with the connector and the pedal is pressed.

10. The drum tune adjustment system of claim 2, wherein the drum tune adjustment system is configured to move the mass of air out of the cavity of the drum when the conduit is attached to the drum with the connector and the pedal is pressed.

11. The drum tune adjustment system of claim 1, further comprising an automatic relief valve configured to vent air out of the cavity of the drum automatically once a desired pressure is exceeded.

12. The drum tune adjustment system of claim 1, further comprising a second conduit fluidly connected with the air pump and a second connector configured to attach the second conduit to a shell of a second drum.

13. A method of adjusting the tune of a drum comprising:

providing a first drum having a cavity defined by a shell, a batter head and a resonant head, wherein the first drum has a pitch when played;

providing a drum tune adjustment system attached to the first drum, the drum tune adjustment system comprising an air pump or an air source;

a conduit fluidly connected with the air pump or the air source and the cavity of the first drum; and a pedal configured to actuate the air pump or open a valve that is fluidly connected with the air source; and pressing the pedal to actuate the air pump or open the valve and move a mass of air between the air pump or air source and the cavity of the drum, thereby altering the pitch of the first drum.

14. The method of claim 13, further comprising:

providing a second drum, which has a pitch when played, and a second conduit fluidly connected with the air pump or air source and the second drum; and pressing the pedal to actuate the air pump or open the valve and move a second mass of air between the air pump or air source through the second conduit, thereby altering the pitch of the second drum.

15. The method of claim 13, wherein the air pump comprises a bellows.

16. The method of claim 13, wherein the air pump comprises a piston and a cylinder.

17. The method of claim 13, wherein the air source comprises a pressurized air container.

18. The method of claim 13, wherein the drum tune adjustment system further comprises a relief valve adapted to vent air into or out of the cavity of the first drum when actuated.

19. The method of claim 13, wherein the drum tune adjustment system further comprises a display for indicating the relative air pressure of the cavity.

20. The method of claim 13, wherein the drum tune adjustment system further comprises a pedal assembly, the pedal assembly being attached to or mechanically, pneumatically, or hydraulically linked to the air pump and mechanically linked to the pedal such that the pedal can move between an extended position and a depressed position.

21. The method of claim 13, wherein the drum tune adjustment system is configured to move the mass of air into the cavity of the drum when the pedal is pressed.

22. The method of claim 13, wherein the drum tune adjustment system is configured to move the mass of air out of the cavity of the drum when the pedal is pressed.

23. The method of claim 13, wherein the drum tune adjustment system further comprises an automatic relief valve configured to vent air out of the cavity of the drum automatically once a desired pressure is exceeded.

24. A method of adjusting the tune of a drum comprising:

providing a drum having a cavity defined by a shell, a batter head and a resonant head, wherein the drum has a pitch when played; and moving a mass of air between an air pump or air source and the cavity of the drum to produce a pressure differential between the cavity of the drum and an exterior of the drum, which pressure differential is effective to change tension on the batter had and the resonant head, thereby altering the pitch of the drum.

25. The drum tune adjustment system of claim 1, which is configured to change tension on the batter head and the resonant head upon the movement of the mass of air between the air pump or air source and the cavity of the drum.

* * * * *